US010687574B2

(12) United States Patent
Williams et al.

(10) Patent No.: US 10,687,574 B2
(45) Date of Patent: Jun. 23, 2020

(54) PROTECTIVE HEADGEAR

(71) Applicant: JSP Limited

(72) Inventors: Mark Williams, Oxford (GB); Clive Johnstone, Witney (GB)

(73) Assignee: JSP Limited, Oxfordshire (GB)

( * ) Notice: Subject to any disclaimer, the term of this patent is extended or adjusted under 35 U.S.C. 154(b) by 68 days.

(21) Appl. No.: 15/742,029

(22) PCT Filed: Jun. 17, 2016

(86) PCT No.: PCT/GB2016/051810
§ 371 (c)(1),
(2) Date: Jan. 4, 2018

(87) PCT Pub. No.: WO2017/006078
PCT Pub. Date: Jan. 12, 2017

(65) Prior Publication Data

US 2018/0192723 A1 Jul. 12, 2018

(30) Foreign Application Priority Data

Jul. 9, 2015 (GB) ..... 1512034.8

(51) Int. Cl.
*A42B 1/08* (2006.01)
*A42B 1/20* (2006.01)
(Continued)

(52) U.S. Cl.
CPC ..... *A42B 1/08* (2013.01); *A42B 1/069* (2013.01); *A42B 1/208* (2013.01); *A42B 3/06* (2013.01);
(Continued)

(58) Field of Classification Search
CPC ..... A42B 1/08; A42B 1/069; A42B 1/208; A42B 3/10; A42B 3/12; A42B 3/124;
(Continued)

(56) References Cited

U.S. PATENT DOCUMENTS 1,456,183 A * 5/1923 Knight ..... A42B 1/08 2/412
2,081,335 A * 5/1937 Levinson ..... A42B 3/00 2/412
(Continued)

FOREIGN PATENT DOCUMENTS

DE 20 2006 003413 U1 6/2006
DE 10 2006 058782 A1 6/2008
(Continued)

OTHER PUBLICATIONS

Translation of EP1136007 (Year: 2019).*
(Continued)

*Primary Examiner* — Khaled Annis
*Assistant Examiner* — Dakota Marin
(74) *Attorney, Agent, or Firm* — Ryan S. Dean; Umberg Zipser LLP

(57) ABSTRACT

A liner (10) for fitting within a headcap to provide a degree of impact protection, said liner comprising a generally concave shell for receiving a wearer's head, in use, and having a top section (16), a front section (12) and a rear section (14), and a pair of side panels extending downward from, and integrally formed with, respective side edges of said top section (16), wherein a first slot (14*a*) is provided on each side of said rear section (14), extending from a side edge thereof to a hinge portion (14*b*) located between said top portion (16) and said rear section (14), and a second slot (12*a*) is provided on each side of said front section (12) extending from a side edge thereof to a hinge portion (12*b*) located between said top portion (16) and said front section (12).

14 Claims, 7 Drawing Sheets

(51) Int. Cl.
*A42B 3/10* (2006.01)
*A42B 3/06* (2006.01)
*A42B 3/12* (2006.01)
*A42B 1/06* (2006.01)

(52) U.S. Cl.
CPC ..... *A42B 3/063* (2013.01); *A42B 3/065* (2013.01); *A42B 3/066* (2013.01); *A42B 3/069* (2013.01); *A42B 3/10* (2013.01); *A42B 3/105* (2013.01); *A42B 3/12* (2013.01); *A42B 3/124* (2013.01); *A42B 3/125* (2013.01)

(58) Field of Classification Search
CPC ..... A42B 3/065; A42B 3/066; A42B 3/069; A42B 3/105; A42B 3/06; A42B 3/063; A42B 3/125
USPC ..... 2/414
See application file for complete search history.

(56) References Cited

U.S. PATENT DOCUMENTS 3,153,792 A * 10/1964 Marietta ..... A42B 3/127 2/414
3,551,911 A * 1/1971 Holden ..... A42B 3/00 2/411
3,629,864 A * 12/1971 Latina ..... A42B 3/324 2/420
5,010,598 A * 4/1991 Flynn ..... A42B 3/06 2/410
5,461,730 A * 10/1995 Carrington ..... A42B 1/08 2/205
5,517,698 A * 5/1996 Nault ..... A42B 3/066 2/424
5,581,818 A * 12/1996 Lorenzi ..... A42B 1/08 2/411
5,734,994 A * 4/1998 Rogers ..... A42B 3/12 2/411
6,131,207 A * 10/2000 Basson ..... A42B 3/0473 2/410
6,367,090 B1 * 4/2002 Im ..... A42B 3/00 2/411
6,453,476 B1 * 9/2002 Moore, III ..... A42B 3/125 2/412
7,913,325 B2 * 3/2011 Bullock ..... A42B 3/066 2/410
7,958,572 B2 * 6/2011 Loury ..... A42B 3/322 2/410
2002/0035748 A1 * 3/2002 Racine ..... A42B 3/12 2/414
2004/0045078 A1 * 3/2004 Puchalski ..... A42B 3/324 2/411
2004/0181854 A1 * 9/2004 Primrose ..... A42B 1/08 2/411
2006/0168712 A1 * 8/2006 Mazzoccoli ..... A42B 1/08 2/411
2007/0130673 A1 * 6/2007 Wasserkrug ..... A42B 1/08 2/411
2009/0222975 A1 * 9/2009 Green ..... A42B 1/08 2/410
2010/0005573 A1 * 1/2010 Rudd ..... A42B 3/062 2/414
2012/0017358 A1 * 1/2012 Princip ..... A42B 3/064 2/414
2012/0047635 A1 * 3/2012 Finiel ..... A42B 3/125 2/414
2012/0216338 A1 * 8/2012 Arrouart ..... A42B 3/322 2/410
2013/0025032 A1 * 1/2013 Durocher ..... A42B 3/064 2/414
2013/0152286 A1 * 6/2013 Cormier ..... A42B 3/124 2/459
2013/0174331 A1 * 7/2013 Witcher ..... A42B 3/122 2/413
2013/0191972 A1 * 8/2013 Woolf ..... A42B 3/322 2/410
2014/0020158 A1 * 1/2014 Parsons ..... A42B 3/122 2/413
2014/0201885 A1 * 7/2014 Rackerby ..... A42B 1/08 2/181
2016/0345651 A1 * 12/2016 Dvorak ..... A42B 3/124

FOREIGN PATENT DOCUMENTS

DE 102006058782 A1 * 6/2008 ..... A42B 1/08
EP 1136007 A2 * 9/2001 ..... A42B 1/08
EP 1136007 A2 9/2001

OTHER PUBLICATIONS

Translation of DE102006058782 (Year: 2019).*
EPO/ISA, international search report for PCT application No. PCT/GB2016/051810, dated Sep. 30, 2016, 4 pages.

* cited by examiner

PROTECTIVE HEADGEAR

This invention relates generally to protective headgear and more particularly, but not necessarily exclusively, to a protective liner for fitting in a soft headcap to provide impact protection, and a headcap including such a liner.

Hard hats are well known for use in various working environments in which protection from impact is required. Utility hard hats tend to be rigid shells and include a suspension harness cradle which is adjustable in terms of horizontal circumference (typically 53-64 cm), and sometimes also vertically at two or three height settings to enable a snug fit of the harness cradle about a wearer's head to be achieved. However, due to their weight and bulky nature, as well as the limited ventilation afforded thereby, conventional hard hats can become quite uncomfortable after prolonged use.

In some working environments, the degree of impact protection required may be lower than others, at least in some areas or during certain activities where the risk of injury is relatively low; and in such cases, it may not be required for operatives to wear a hard hat, although some impact protection would be desirable. Thus, it is also known to fit protective liners into soft caps, such as baseball caps, to provide some impact protection by means of a reasonably stylish, relatively lightweight item of headgear that provides more ventilation than conventional hard hats, thereby increasing user comfort for prolonged use.

Known liners of this type are generally dome shaped and of a fixed size, and, unlike conventional hard hats, rest directly against a wearer's head, in use. As a result, they may feel tight on a larger head and insecure on a smaller head. It is, therefore, highly desirable to provide the ability to adjust such liners for a secure fitting and, in some cases, this has been limited to a releasable strap at the rear of the cap. However, the rigid nature of a solid liner significantly limits the flexibility or "shaping" possibility to provide a comfortable fit for a variety of head sizes.

International Patent Application No. WO03/005843 addresses this issue to a certain extent and proposes a generally concave shell of ABS plastics material, that is lower at the front than the back. A pair of elongate slots, extending from the back to a point near the front of the shell, is provided so as to divide the shell into four sections: (i) a top section extending from the back rim along the length of the slots to provide crown protection, in use; (ii) a front section extending from the closed end of the slots to correspond with a user's forehead and provide protection therefor, in use; and (iii) first and (iv) second side sections for providing side impact protection, in use. The slots, coupled with the inherent flexibility of the shell material, enable the side sections to move inward and outward to accommodate smaller and larger heads sizes, due to the hinge action created at the closed ends of the slots between the above-mentioned various sections of the shell.

However, there are a number of drawbacks associated with the prior art arrangement described above. Firstly, no ventilation is provided in the side sections, which would make the proposed liner uncomfortable for prolonged use. On the other hand, if ventilation holes were to be provided in the side sections, these would necessarily have to cover a relatively small area thereof because, otherwise, the strength and effectiveness thereof would be unacceptably compromised.

Another significant drawback of the above-described prior art is that there is no provision for adjustment at the front of the shell, which is effectively a rigid band. This issue was, to a certain extent, addressed in EP1136007 which describes a flexible shell including a top section, a front section and a back section, wherein slots are provided on either side of both the front and back sections so as to define respective hinges between the front and back sections and the top section, such that both the front and back sections can be flexed radially and, therefore, adjusted to more closely follow the shape of the wearer's head, in use.

However, the above-mentioned prior art does not provide any integral side impact protection. Provision is mentioned in passing for the attachment of side impact panels to the edges of the top section, if required, but such attachment would result in a substantially rigid double-layered join, that would introduce an area of potential discomfort for the wearer and, potentially, risk of injury if an impact should occur at the location of the join. Furthermore, the requirement to attach the side impact panels significantly reduces the effective area thereof in which ventilation holes could be provided without unacceptable loss of side impact protection.

Thus, it can be seen that there is, in the prior art proposals, a trade-off between performance (i.e. degree and effectiveness of impact protection), ventilation, adjustability and weight, and it is an object of aspects of the present invention to address at least some of these issues.

In accordance with a first aspect of the present invention, there is provided a liner for fitting within a headcap to provide a degree of impact protection, said liner comprising a generally concave shell for receiving a wearer's head, in use, and having a top section, a front section and a rear section, and a pair of side panels extending downward from, and integrally formed with, respective side edges of said top section, wherein a first slot is provided on each side of said rear section, extending from a side edge thereof to a hinge portion located between said top portion and said rear section, and a second slot is provided on each side of said front section extending from a side edge thereof to a hinge portion located between said top portion and said front section.

In an exemplary embodiment, each second slot may extend downward from its open end at said side edge of said front section, between said front section and a respective side panel. The width of said second slot optionally increases uniformly along its length from said respective hinge portion.

A third slot may be provided in each side panel that extends upwardly from a rim thereof. In this case, the third slot may extend upwardly from a generally central location along the rim of said side panel, optionally along at least half of its length.

In an exemplary embodiment, the liner may be formed of a resiliently flexible material, such as a plastics material (e.g. ABS plastic) that, in use, permits a degree of resilient flexing at the joins between the top, front and rear sections and the side panels as defined by the first and second slots.

Each side panel optionally comprises one or more ventilation holes. For example, each side panel may comprise a pattern of ventilation holes that extends from a point adjacent to the integral connection between the respective side panel and the top section along a portion of the length thereof, said pattern including an uninterrupted portion that extends along a substantial portion of the width of the respective side panel.

The top section may include at least one raised rib on its outer surface. The outer surface of the top section is optionally provided with a plurality of substantially parallel, raised ribs extending between the front and rear sections. Ventilation holes may be provided in the ribs. In an exemplary embodiment, each rib may be provided with a plurality of spaced-apart ventilation holes along its length.

A portion of cushioning material is optionally provided on the inner surface of the top section. The portion of cushioning material may comprise an expanded polypropylene (EPP) impact pad.

In accordance with another aspect of the present invention, there is provided a headcap incorporating a liner as described above.

In accordance with yet another aspect of the present invention, there is provided a kit comprising a headcap and a liner as described above for insertion into, and engagement with, said headcap.

These and other aspects of the present invention will become apparent from the following specific description in which an embodiment of the present invention is described, by way of example only, and with reference to the accompanying drawings, in which.

Figure 1:
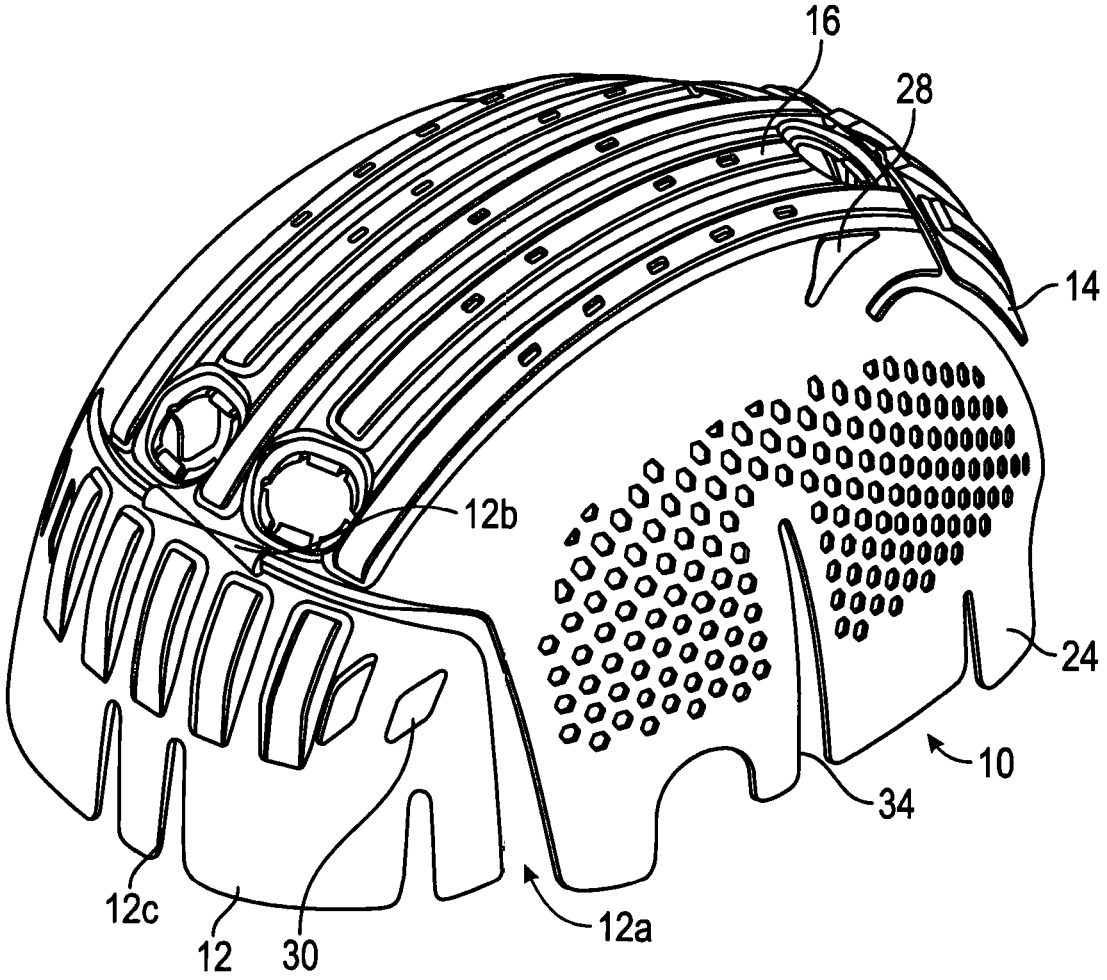
FIG. 1 is a schematic perspective side view of a liner according to an exemplary embodiment of the present invention.
Figure 2:
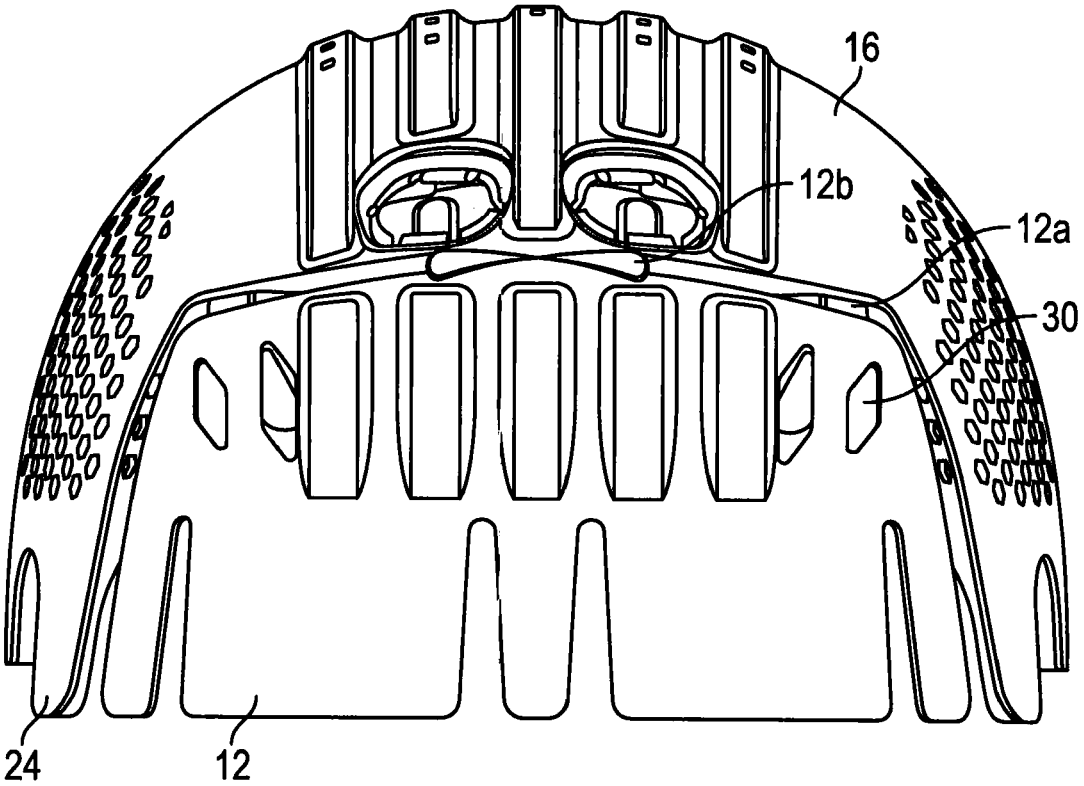
FIG. 2 is a schematic front view of the liner of FIG. 1.

Referring to FIGS. 1 and 2 of the drawings, a liner 10 according to an exemplary embodiment of the present invention comprises a generally dome-shaped shell of concave configuration for receiving a wearer's head, in use. The shell comprises a front portion 12, a rear portion 14 and a top portion 16. The front portion 12 is defined by a pair of slots 12*a* formed either side thereof, each slot extending inwardly from a respective side edge thereof and terminating at a generally central hinge portion 12*b* between the top portion 16 and the front portion 12. The rim of the front portion 12 is provided with grooves or slots 12*c*, so as to define a profiled edge intended to enable the liner 10 to be inserted into, and engage with, a soft cap.

Figure 3:
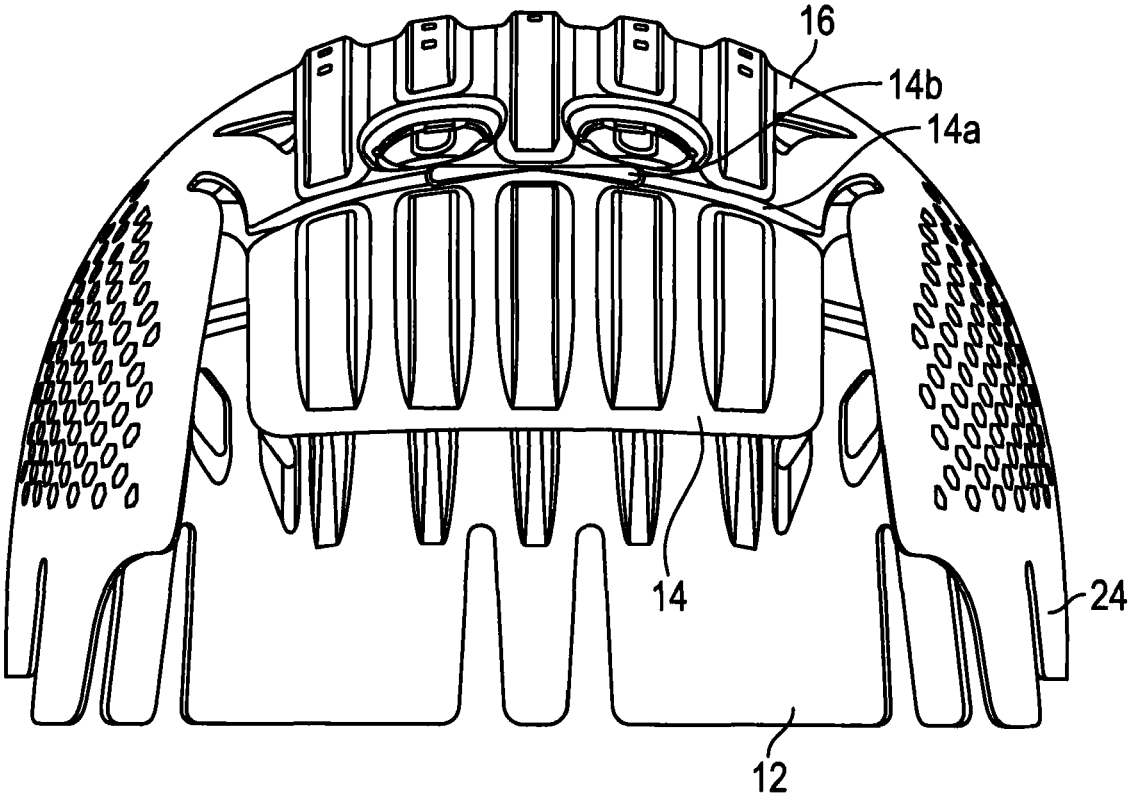
FIG. 3 is a schematic rear view of the liner of FIG. 1.

Referring additionally to FIG. 3 of the drawings, the rear portion 14 is shorter than the front portion 12, i.e. the front portion 12 extends down from the top section 16 by a greater amount than the rear portion 14. The rear portion 14 is defined by a pair of slots 14*a* on either side thereof, wherein each slot 14*a* extends from a respective side edge of the rear portion 14, along its top edge, and terminates at a generally central hinge portion 14*b* between the top portion 16 and the rear portion 14.

Figure 4:
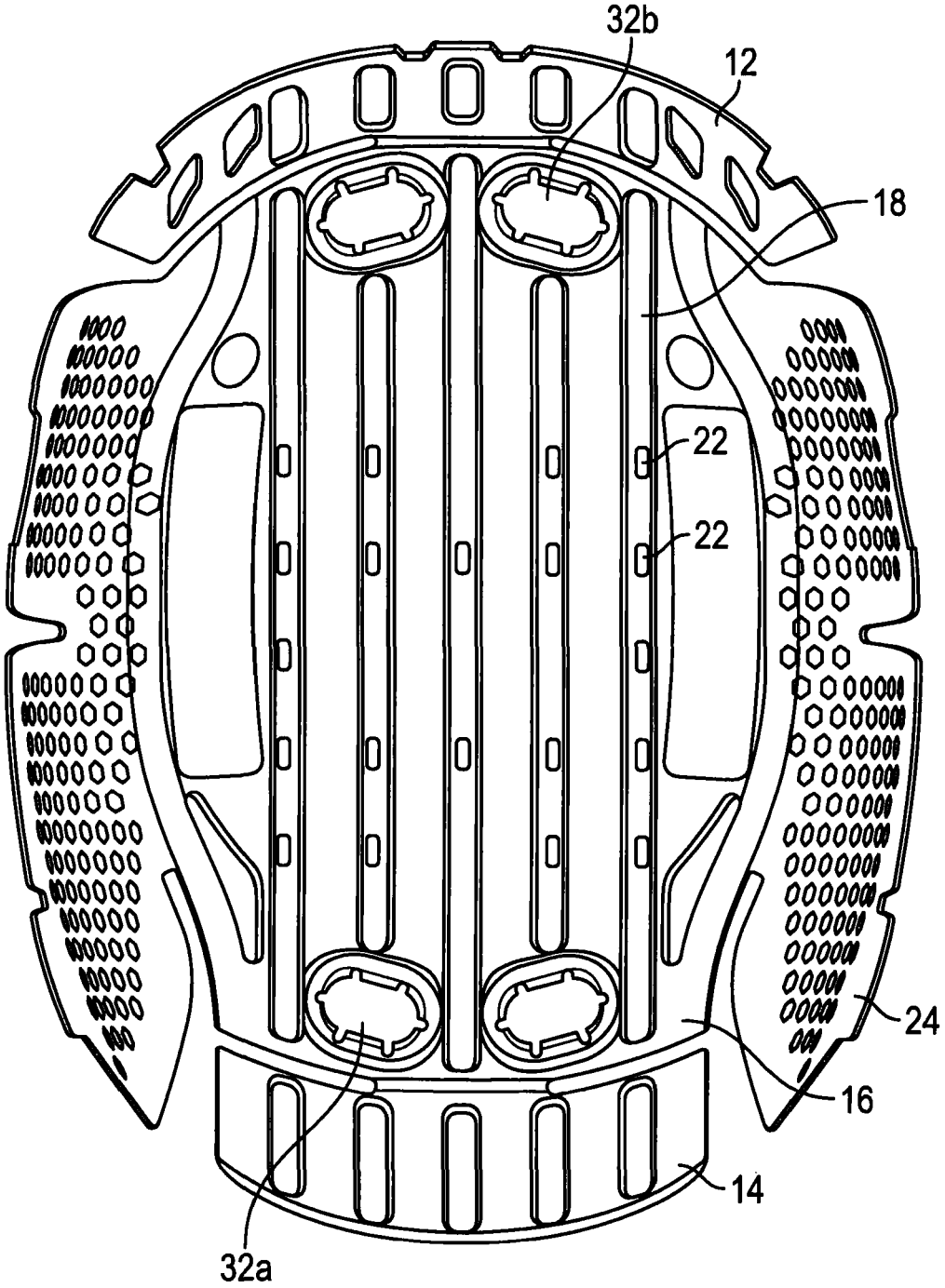
FIG. 4 is a schematic plan view of the liner of FIG. 1.

Referring to FIG. 4 of the drawings, the top portion 16, which provides crown impact protection, in use, has an outer convex surface provided with a plurality of substantially parallel, raised ribs 18 between the front and rear portions 12, 14. Each rib 18 is provided with a plurality of ventilation holes 22 in spaced apart relation along their length. Corresponding ribs 18*a*, 18*b* are provided on the front and rear portions 12, 14 respectively.

Figure 5:
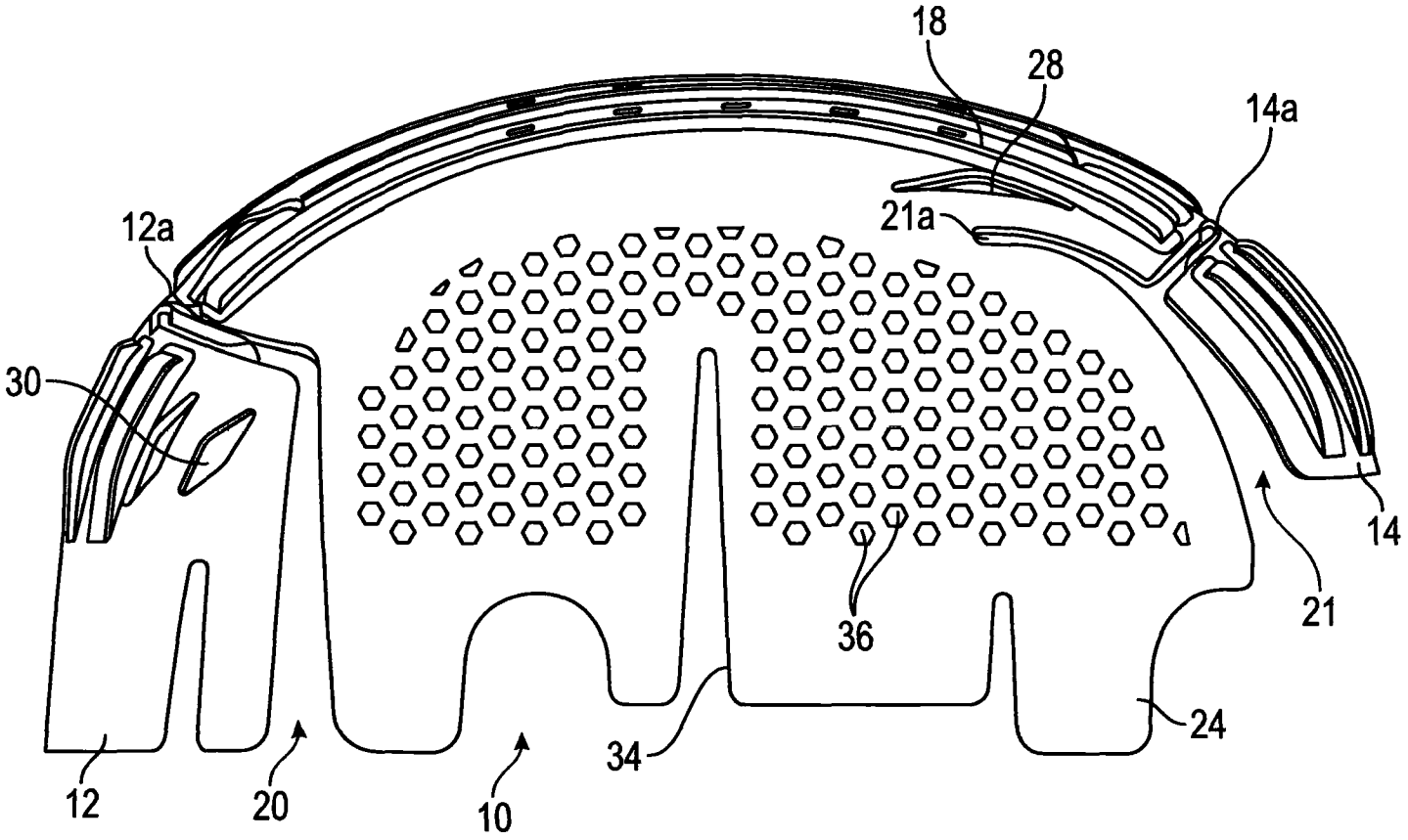
FIG. 5 is a schematic side view of the liner of FIG. 1.

Referring additionally to FIG. 5 of the drawings, the liner 10 comprises a pair of side panels 24, wherein each side panel is integrally formed with, and extends downwardly from a side edge of the top portion 16. It can be seen from FIG. 5 of the drawings that an elongate gap 20 is provided between the front portion 12 and each respective side panel 24, wherein the gap 20 extends from the open end of a respective slot 12*a* and increases substantially uniformly in width along the length of the side panel. Similarly, a gap 21 is provided between the rear portion 14 and a respective side panel 24, which extends from the open end of the slot 14*a* and increases in width substantially uniformly along its length. The gap 21 extends into a cutaway portion 21*a* between the side panel and the top portion 16, to further increase adjustability. A cutaway portion 28 is provided on each side of the top portion 16, close to its rear end, to further increase ventilation and reduce the amount of material used and, therefore, the weight of the liner 10. Further cutaway portions 30 may be provided, for example, in the front portion 12 for the same reason. A pair of connector apertures 32*a*, 32*b* is provided at opposing ends of the top portion 16 for the purpose of enabling the liner to be attached within a soft cap.

A further slot 34 is provided in each side panel 24, which extends from a generally central location at the lower edge thereof, upwards to a point at least half way along its length, thereby further increasing the degree of adjustability provided by the assembly. A pattern of ventilation holes 36 is provided on each side panel 24. It can be seen that, due to the configuration of the overall assembly, and the manner in which the side panels and top portion are configured relative to each other in particular, that the pattern of ventilation holes 36 can occupy a relatively large surface area of each side panel 24. Part of the pattern extends across a substantial portion of the width of the entire side panel, and the remaining portion of the pattern extends down a substantial proportion of the side panel, thereby maximising the degree of ventilation offered and comfort offered, without significant detrimental effect on the performance of the side panels in terms of side impact protection. The lower edge of each side panel is profiled to enable the liner 10 to be inserted into, and engage with, a soft cap.

Figure 6:
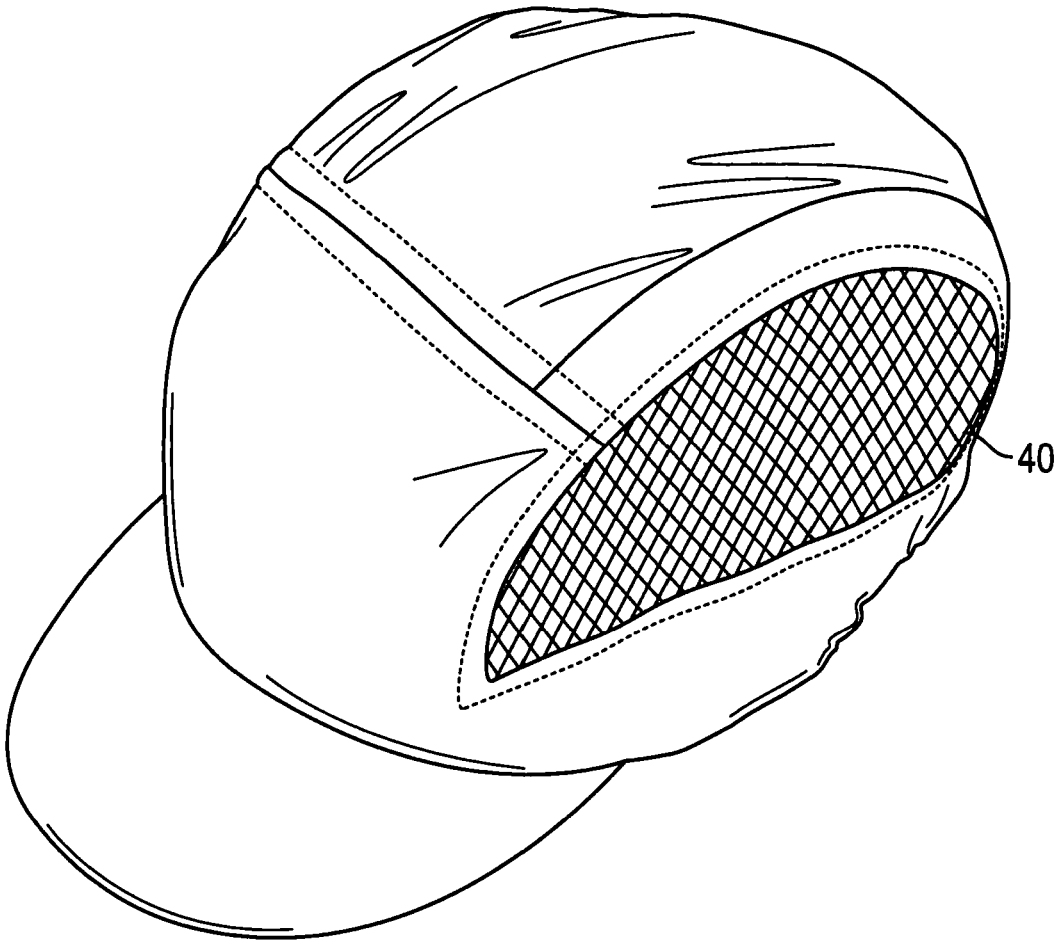
FIG. 6 is a perspective view of a soft cap incorporating a liner according to an exemplary embodiment of the present invention.
Figure 7:
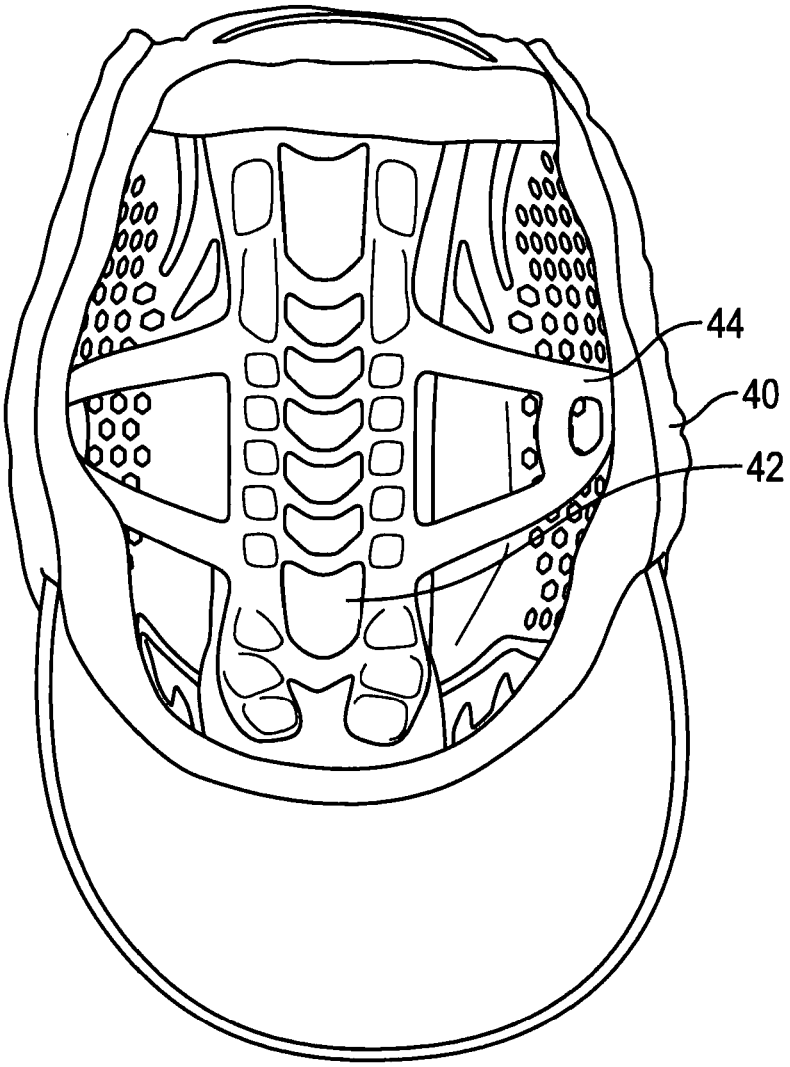
FIG. 7 is an inside plan view of the soft cap of FIG. 6.

Referring to FIGS. 6 and 7 of the drawings, in use, the liner 10 is inserted into a soft cap 40, whereby the profiled edges of the front portion 12 and the side panels 24 engage with the soft cap via an inner, circumferential hem or channel (not shown). An impact pad 42 is provided on the inner surface of the top portion of the liner, for additional comfort and protection, in use. The impact pad 42 is formed, in this exemplary embodiment, of expanded PolyPropylene (EPP) which enables it to be somewhat smaller and thinner than conventional foam impact pads provided in prior art arrangements. An additional sweat liner 44 may also be provided for additional user comfort.

Overall, aspects of the present invention provide a liner that is lighter in weight than those proposed in the prior art, without significant detriment to the overall impact protection performance thereof. In addition, greater provision for ventilation is made possible by the overall configuration of the liner, and the ability for adjustment is maximised, again without detriment to the overall performance of the liner.

It will be appreciated by a person skilled in the art, from the foregoing description, that modifications and variations can be made to the described embodiments, without departing from the scope of the invention as defined by the appended claims.

The invention claimed is:

1. A liner for fitting within a headcap to provide a degree of impact protection, said liner comprising a concave shell for receiving a wearer's head, in use, and having a top section, a front section and a rear section, and a pair of side panels extending downward from, and integrally formed with, respective side edges of said top section, wherein a first slot is provided on each side of said rear section, extending from a side edge thereof to a portion located between said top portion and said rear section, wherein a gap is provided between said rear section and a respective side panel, wherein said gap extends into a cutaway portion between said respective said panel and said top portion and a second slot is provided on each side of said front section extending from a side edge thereof to a portion located between said top portion and said front section, wherein each of an outer surface of the of the top section an outer surface of the front section and an outer surface of the reaar section are provided with a plurality of raised ribs;

wherein each side panel comprises a pattern of ventilation holes that extends across and down said side panel; and said liner further comprising an impact pad and sweat liner on an inner surface of the top portion and extending over an inner surface of each side panel comprising said pattern of ventilation holes.

2. The liner according to claim 1, wherein each second slot extends downward from its open end at said side edge of said front section, between said front section and a respective side panel.

3. The liner according to claim 1, wherein a gap extends from an end of the second slot between the front section and a respective side panel, and a width of said gap increases uniformly along its length from said respective portion.

4. The liner according to claim 1, wherein a third slot is provided in each side panel that extends upwardly from a rim thereof.

5. The liner according to claim 4, wherein said third slot extends upwardly from a generally central location along the rim of said side panel.

6. The liner according to claim 4, wherein the third slot extends from the rim of the side panel along at least half of its length.

7. The liner according to claim 1, formed of a plastic material.

8. The liner according to claim 1, wherein the plurality of raised ribs are parallel to each other and between the front and rear sections.

9. The liner according to claim 1, wherein ventilation holes are provided in at least one of the ribs in the top section.

10. The liner according to claim 1, wherein said comprises an expanded polypropylene (EPP) impact pad.

11. A liner for fitting within an item of headwear, said liner comprising a concave shell comprising:

a top portion, a front portion, a rear portion, and a pair of side panels, wherein each side panel is integrally formed with and extends downwardly from a side edge of said top portion and comprises a pattern of ventilation holes that extends across and down the side panel;

wherein a pair of slots is provided on either side of said front portion extending from a side edge thereof to a portion located between said top portion and said front portion; and a pair of slots is provided on either side of said rear portion, extending from a side edge thereof to a portion located between said top portion and said rear portion, wherein a gap is provided between said rear portion and a respective side panel, wherein sad gap extends into a cutaway portion between said respective side panel and said top portion, and wherein an outer surface of the top portion is provided with a plurality of raised ribs between the front and rear portions, and raised ribs are provided on outer surfaces of the front and rear portions respectively, and wherein said liner further comprising an impact pad and sweat liner on an inner surface of the top portion and extending over an inner surface of each side panel comprising said pattern of ventilation holes.

12. The liner according to claim 11, formed of a resiliently flexible material that, permits resilient flexing between the top portion and the front portion, the rear portion, and the side panels respectively.

13. The liner according to claim 11, wherein at least one rib in the top portion is provided with a plurality of spaced-apart ventilation holes along its length.

14. An item of headwear, comprising:

a soft cap; and a liner comprising:

a top portion, a front portion, a rear portion, and a pair of side panels, wherein each side panel is integrally formed with and extends downwardly from a side edge of said top portion and compromises a pattern of ventilation holes that extends accross and down the side panel;

wherein a pair of slots is provided on either side of said front portion extending from a side edge thereof to a portion located between said top portion and said front portion, wherein a gap is provided between said rear portion and a respective side panel, wherein sad gap extends into a cutaway portion between said respective side panel and said top portion; and a pair of slots is provided on either side of said rear portion, extending from a side edge thereof to a portion located between said top portion and said rear portion, and wherein an outer surface of the top portion is provided with a plurality of raised ribs between the front and rear portions, and raised ribs are provided on outer surfaces of the front and rear portions respectively; and wherein said liner further comprising an impact pad and sweat liner on an inner surface of the top portion and extending over an inner surface of each side panel comprising said pattern of ventilation holes;

wherein the liner is inserted into the soft cap.

* * * * *